US011668158B1

(12) United States Patent
Gahtani

(10) Patent No.: US 11,668,158 B1
(45) Date of Patent: Jun. 6, 2023

(54) TIEBACK CASING TO WORKOVER LINER USING A CROSSOVER

(71) Applicant: SAUDI ARABIAN OIL COMPANY, Dhahran (SA)

(72) Inventor: Hussain Ali Gahtani, Riyadh (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/538,468

(22) Filed: Nov. 30, 2021

(51) Int. Cl.
*E21B 43/10* (2006.01)
*E21B 33/16* (2006.01)

(52) U.S. Cl.
CPC ..... *E21B 33/16* (2013.01); *E21B 43/10* (2013.01)

(58) Field of Classification Search
CPC ..... E21B 33/16; E21B 43/10
See application file for complete search history.

(56) References Cited

U.S. PATENT DOCUMENTS 5,743,335 A * 4/1998 Bussear ..... E21B 33/16 166/242.7
10,428,261 B2 * 10/2019 Sabins ..... C09K 8/426
2005/0263282 A1 * 12/2005 Jeffrey ..... E21B 23/01 166/281
2011/0203795 A1 * 8/2011 Murphy ..... C09K 8/42 166/135
2013/0140022 A1 * 6/2013 Leighton ..... E21B 29/10 166/212
2013/0319671 A1 * 12/2013 Lund ..... E21B 33/13 166/192
2016/0237779 A1 * 8/2016 Husby ..... E21B 33/13
2018/0038196 A1 2/2018 Sahi
2019/0330949 A1 * 10/2019 Krüger ..... E21B 43/112
2020/0088002 A1 * 3/2020 AlShuraim ..... E21B 33/138
2021/0147742 A1 * 5/2021 Pearl, Jr. ..... C09K 8/035
2022/0186575 A1 * 6/2022 Fripp ..... E21B 43/10

FOREIGN PATENT DOCUMENTS

CN 201443306 U 4/2010
EP 2491222 B1 2/2019

* cited by examiner

*Primary Examiner* — Taras P Bemko
(74) *Attorney, Agent, or Firm* — Osha Bergman Watanabe & Burton LLP

(57) ABSTRACT

A method includes running a workover liner, having a workover liner top end, into the workover well, installing a crossover bottom end of a crossover to the workover liner top end, installing a crossover top end of the crossover to a tieback casing bottom end of a tieback casing, running the workover liner, crossover, and tieback casing into the workover well such that the workover liner is set within the production liner, the crossover is set above the liner hanger of the production liner, and the tieback casing is set within the production casing and extends to a surface location. The method further includes cementing the workover liner, crossover, and tieback casing with cement and leaving behind a shoe track. The cement holds the workover liner, crossover, and tieback casing in place within the workover well and prevents leakage of fluids out of the workover well.

20 Claims, 5 Drawing Sheets

TIEBACK CASING TO WORKOVER LINER USING A CROSSOVER

BACKGROUND

Wells are structures formed into the surface of the Earth. Wells access and produce formation fluids from porous formations located far beneath the Earth's surface. The formation fluids may be hydrocarbons or water. Wells are formed from a wellbore supported by casing and/or liners. Wells may be in use for a long period of time, and they often need to be repaired to maintain production of the formation fluids. When a well needs to be repaired it is often called a workover well and the repairs are called workover operations.

One of the primary workover operations includes repairing leaking casing/liners in a workover well. Over time, the original casing/liners of a well may begin to deteriorate and leak formation fluids from the inside of the well to other underground formations. Because the original casing/liners are cemented in place, they cannot be removed from the workover well, thus smaller sized casing/liners are run into the original casing/liners and cemented in place to cover the original casing/liners and prevent future leakage.

In a workover well that originally has both production casing and production liner, a tieback casing string is run into the workover well to cover the original production casing and tieback the original production liner to the surface. Then, a workover liner is run into the workover well, to a depth below the tieback casing, to cover the original production liner. This requires multiple trips and cement jobs which takes up rig time and resources.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present invention presents, in accordance with one or more embodiments, a system and a method for a workover well having a production liner, a liner hanger, and a production casing. The method includes running a workover liner, having a workover liner top end, into the workover well, installing a crossover bottom end of a crossover to the workover liner top end, installing a crossover top end of the crossover to a tieback casing bottom end of a tieback casing, running the workover liner, the crossover, and the tieback casing into the workover well such that the workover liner is set within the production liner, the crossover is set above the liner hanger of the production liner, and the tieback casing is set within the production casing and extends to a surface location. The method further includes cementing the workover liner, the crossover, and the tieback casing with cement and leaving behind a shoe track. The cement holds the workover liner, the crossover, and the tieback casing in place within the workover well and the cement prevents leakage of fluids out of the workover well.

The system includes a tieback casing, a crossover, a workover liner, cement, and a shoe track. The tieback casing has a tieback casing top end, a tieback casing bottom end, and a first outer diameter. The tieback casing is located within the production casing of the workover well and extends to a surface location. The crossover has a crossover top end and a crossover bottom end. The crossover top end is connected to the tieback casing bottom end and the crossover is located in the workover well above the liner hanger of the production liner. The workover liner has a workover liner top end, a workover liner bottom end, and a second outer diameter. The workover liner top end is connected to the crossover bottom end and the second outer diameter is smaller than the first outer diameter. The cement located in an annulus of the tieback casing, the crossover, and the workover line. The shoe track, made of cement, is located within the workover liner bottom end.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments disclosed herein relate to a crossover design to make-up and run a liner on a tie-back casing in one run, and one cement job on the wells required tie-back and liner running to cover the corroded section. Two different sizes (e.g., 9⅝" Tie-Back and 7" Liner or 7"

Tie-Back and 4½" Liner) may be used depending on the well existing casing and liners. Embodiments disclosed herein run the smaller casing (liner), then the cross-over, and then the larger casing size, tied-back to surface and set on slips. The cross-over final depth is approximately +/−100 ft above the existing liner hanger. This is typical for the cases when the high cement hydrostatic and formation breaking is not a concern like most of the workover wells where the well is cased and the formation is isolated with bridge plugs.

Figure 1:
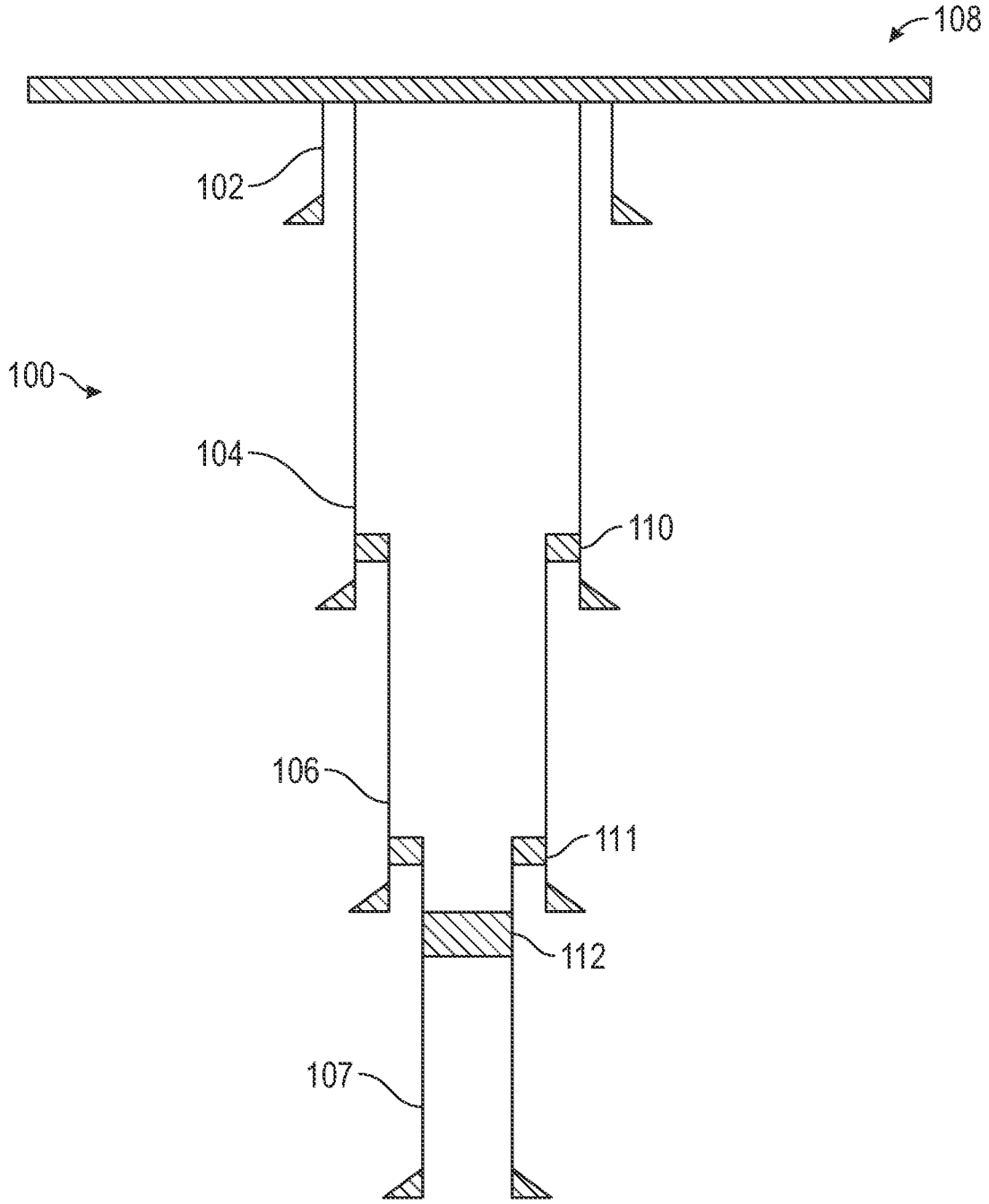
FIG. 1 depicts an exemplary workover well in accordance with one or more embodiments.

FIG. 1 depicts an exemplary workover well (100) in accordance with one or more embodiments. The workover well (100) includes a surface casing (102), a production casing (104), a first production liner (106), and a second production liner (107). The surface casing (102) is the shallow-most set casing string. The surface casing (102) is made out of a plurality of joints of casing threaded together. The joints of casing are tubulars made out of a durable material, such as steel. The surface casing (102) extends to a surface location (108). The surface location (108) is any location along the Earth's surface. The surface casing (102) may extend to a wellhead (not pictured) located on the surface location (108). The purpose of the surface casing (102) may be to isolate shallower formations from deeper formations. Thus, the surface casing (102) is the first wellbore drilled into the ground and the first casing set. The surface casing (102) is cemented in place.

The production casing (104) is set at a depth deeper (i.e., further away from the surface location (108)) than the set depth of the surface casing (102). The production casing (104) is made out of a plurality of joints of casing threaded together. The joints of casing are tubulars made out of a durable material, such as steel. The production casing (104) extends to the surface location (108). The production casing (104) may also extend to the wellhead located on the surface location (108). The purpose of the production casing (104) may be to prevent formation fluids from entering the well and to provide support for the first production liner (106) and any other subsequent liners. The wellbore for the production casing (104) is drilled after the surface casing (102) has been cemented in place. The production casing (104) is run into said wellbore and cemented in place.

The first production liner (106) and the second production liner (107) may also be made out of a plurality of joints of casing threaded together. The joints of casing may be solid steel joints such as the casing used for the surface casing (102) and the production casing (104). In other embodiments, the joints of casing for the second production liner (107) may be made of out screens or slotted liner to aid in production of formation fluids. The first production liner (106) is set within a wellbore drilled after the production casing (104) is cemented in place. The first production liner (106) does not extend to the surface location (108).

The first production liner (106) is hung off of the production casing (104). Typically, the first production liner (106) is hung off of the deepest casing joints of the production casing (104). The first production liner (106) extends to a depth deeper than the production casing (104). The first production liner (106) is hung off of the production casing (104) using a liner hanger (110). The liner hanger (110) may use mechanical slips to grip the inside of the production casing (104) to hold the first production liner (106) in place. The first production liner (106) is cemented in place.

The second production liner (107) is set within a wellbore drilled after the first production liner (106) is cemented in place. The second production liner (107) does not extend to the surface location (108). The second production liner (107) is hung off of the first production liner (106). Typically, the second production liner (107) is hung off of the deepest casing joints of the first production liner (106). The second production liner (107) extends to a depth deeper than the first production liner (106). The second production liner (107) is hung off of the first production liner (106) using a liner hanger (111). The second production liner (107) may or may not be cemented in place depending on the lower completions design.

The workover well (100) depicted in FIG. 1 may be leaking from the first production liner (106) and the production casing (104). As such, a workover operation may be performed. Prior to the workover operation beginning, a bridge plug (112) is set within the second production liner (107). The bridge plug (112) may be any type of bridge plug (112) known in the art and it may be removable or permanent. In one or more embodiments, sand is on top of the bridge plug (112). The bridge plug (112) temporarily prevents the migration of formation fluids into the first production liner (106) and production casing (104) so that the workover operation may be performed. The bridge plug (112) also limits the volume of cement required to perform the workover operation.

Common workover operations that are used to repair leaking production casing (104) and first production liner (106) include running a tieback casing into the workover well (100) to cover the production casing (104) and tieback the first production liner (106) to the surface location (108). Then, a workover liner is run into the workover well (100), to a depth below the tieback casing, to cover the first production liner (106). This requires multiple trips and cement jobs which take up rig time and resources. Therefore, systems and methods that allow for the tieback casing and the workover liner to be run and cemented into a workover well (100) on one trip are beneficial. As such, embodiments disclosed herein present systems and methods that use a crossover to run and cement a tieback casing and workover liner into a workover well (100) on one trip.

Figure 2:
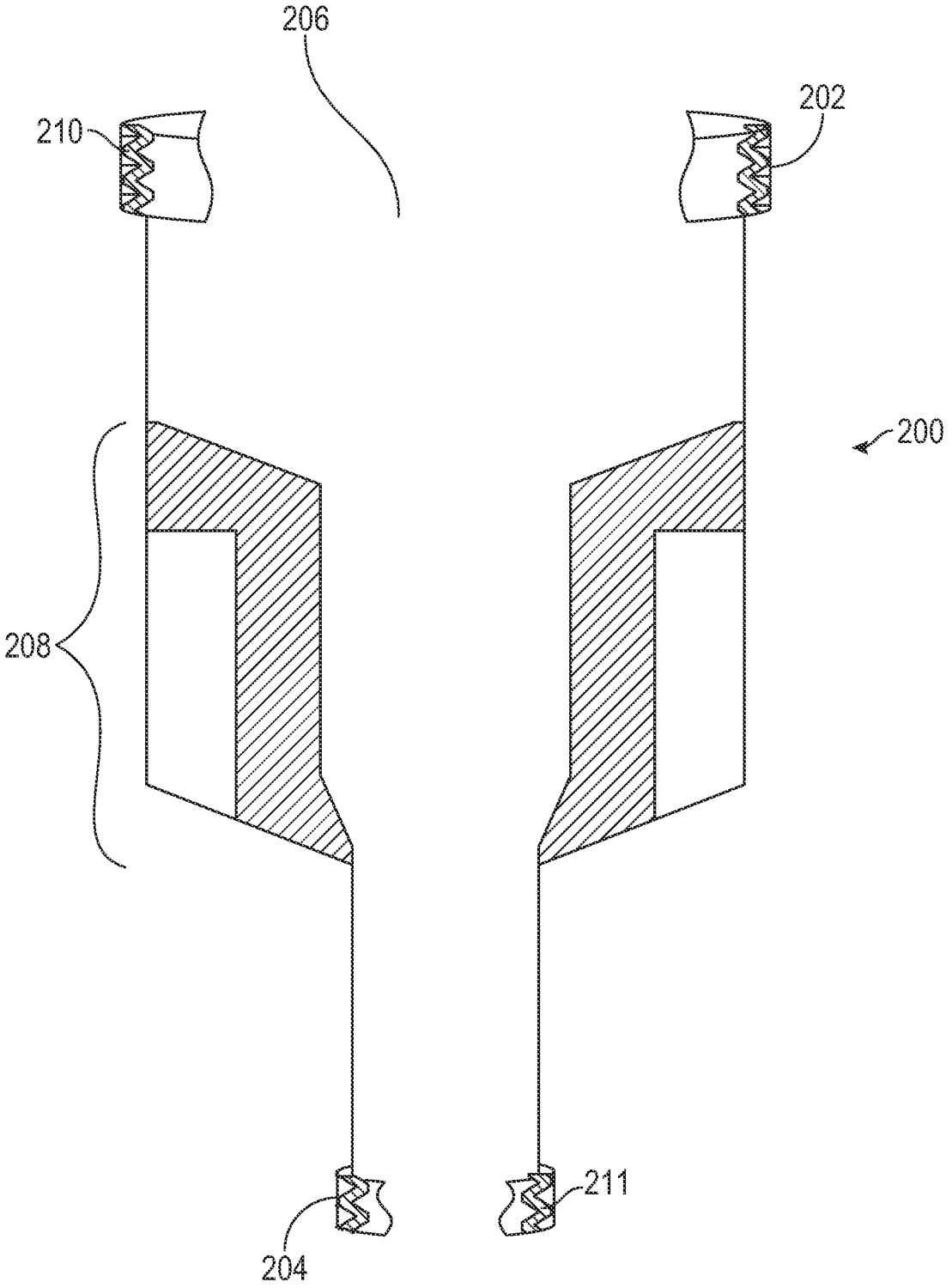
FIG. 2 depicts a crossover in accordance with one or more embodiments.

FIG. 2 depicts a crossover (200) in accordance with one or more embodiments. Specifically, FIG. 2 shows a cross sectional view of the crossover (200). The crossover (200) is a tubular body having a crossover top end (202) and a crossover bottom end (204). A conduit (206) extends from the crossover top end (202) to the crossover bottom end (204). The crossover top end (202) and the crossover bottom end (204) have different inner diameters and outer diameters from one another.

A transitional phase (208) exists between the crossover top end (202) and the crossover bottom end (204). The transitional phase (208) includes a tapering of the inner diameter and the outer diameter to change from the size of the crossover top end (202) to the size of the crossover bottom end (204). The transitional phase (208) may be a smooth transition/taper, or the transitional phase (208) may include one or more shoulders that aid in the tapering as shown in FIG. 2. The inner most area of the transitional phase (208) may act as a polished bore receptacle for future tie back of a workover liner to the surface in the event of corrosion of a tie-back casing. The crossover top end (202) is a box end having internal threads (210). The crossover bottom end (204) is a pin end having external threads (211). The internal threads (210) and external threads (211) may be any type of thread known in the art such as box threads, tapered threads, etc.

In one or more embodiments, for example, the crossover top end (202) may have an outer diameter ranging from 9.625 inches to 7 inches and an inner diameter ranging from 8.921 inches to 6.276 inches. The transitional phase (208)

may have an inner diameter ranging from 7.375 inches to 5.25 inches. The crossover bottom end (204) may have an outer diameter ranging from 7 inches to 4.5 inches and an inner diameter ranging from 6.276 inches to 4 inches. Those skilled in the art will appreciate that the above dimensions are for example purposes only, and that other diameters measurements may be employed without departing from the scope disclosed herein.

Figure 3:
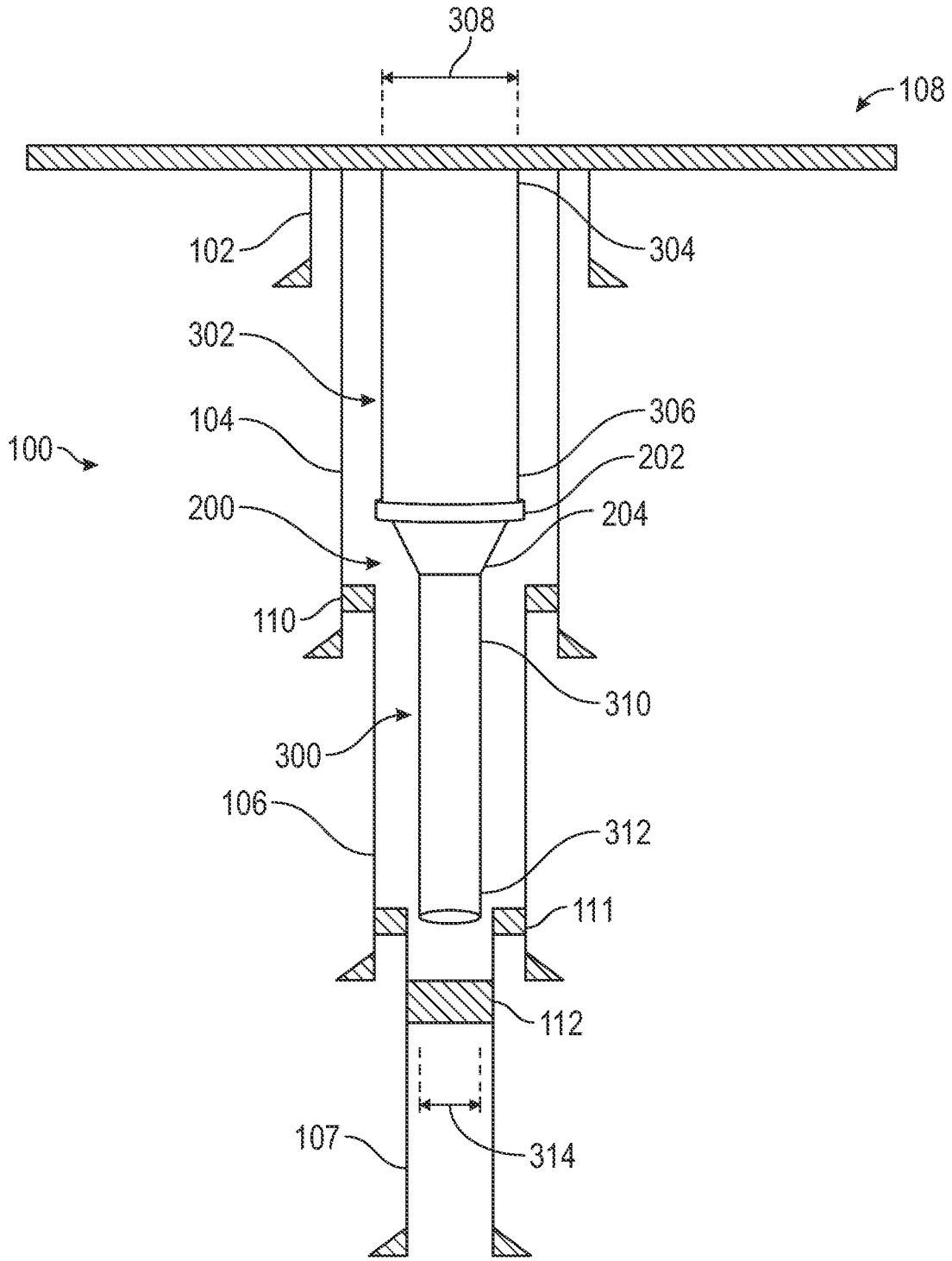
FIG. 3 depicts a system incorporating the crossover in accordance with one or more embodiments.

FIG. 3 depicts a system incorporating the crossover (200) in accordance with one or more embodiments. Specifically, FIG. 3 shows the crossover (200), depicted in FIG. 2, being used to run a workover liner (300) and a tieback casing (302) into the workover well (100), depicted in FIG. 1, in one trip. Components shown in FIG. 3 that are the same as or similar to components shown in FIGS. 1 and 2 have not been redescribed for purposes of readability and have the same function as described above.

The tieback casing (302) has a tieback casing top end (304) and a tieback casing bottom end (306). The tieback casing bottom end (306) is a pin end with external threads (not pictured). The tieback casing (302) has a first outer diameter (308). In one or more embodiments, the first outer diameter (308) ranges from 9.625 inches to 7 inches. The tieback casing (302) is made out of a plurality of joints of casing threaded together. The joints of casing are tubulars made out of a durable material, such as steel. The tieback casing (302) is located within the production casing (104) of the workover well (100) and extends to the surface location (108).

The workover liner (300) has a workover liner top end (310) and a workover liner bottom end (312). The workover liner top end (310) is a box end with internal threads (not pictured). The workover liner (300) has a second outer diameter (314). The second outer diameter (314) is smaller than the first outer diameter (308). In one or more embodiments, the second outer diameter (314) rangers from 7 inches to 4.5 inches. The workover liner (300) is made out of a plurality of joints of casing threaded together. The joints of casing are tubulars made out of a durable material, such as steel. The workover liner (300) is located in the first production liner (106) and the workover liner top end (310) extends to a depth within the production casing (104). In one or more embodiments, the workover liner bottom end (312) stings into the second production liner (107) as shown in FIG. 3. Specifically, the internal profile of the liner hanger (111) may act as a polished bore receptacle and the workover liner bottom end (312) may sting into the liner hanger (111). The workover liner (300) may be made up of the following, listed in order from the workover liner bottom end (312) to the workover liner top end (310), a half-cut joint of casing that may act as a mule shoe, two full joints of casing, a float collar with a check valve, and the remainder of the joints of casing.

The crossover (200) is used to connect the workover liner (300) to the tieback casing (302). Specifically, the internal threads (210) of the crossover top end (202) mate with the external threads of the tieback casing bottom end (306) and the external threads (211) of the crossover bottom end (204) mate with the internal threads of the workover liner top end (310). The outer diameter of the crossover bottom end (204) is equal to the second outer diameter (314). The tieback casing bottom end (306) is connected to the crossover top end (202). The outer diameter of the crossover top end (202) is equal to the first outer diameter (308).

The tieback casing top end (304) is located at the surface location (108). The workover liner bottom end (312) is located within the second production liner (107) in proximity to the bridge plug (112). In accordance with one or more embodiments, the workover liner bottom end (312) is stung into the internal profile of the liner hanger (111) which is mounted to the second production liner (107). The crossover (200) is located within the production casing (104). In one or more embodiments, the crossover (200) is located about 100 feet above (i.e., closer to the surface location (108)) the depth of the first production liner's (106) liner hanger (110). The workover liner (300) was run into the workover well (100) by the tieback casing (302) connected to the crossover (200). In a scenario where the tieback casing (302) corrodes or fails after extended use, another tieback casing (not pictured) may be run into the tieback casing (302) and may extend from the surface location (108) into the polished bore receptacle of the crossover (200).

Figure 4B:
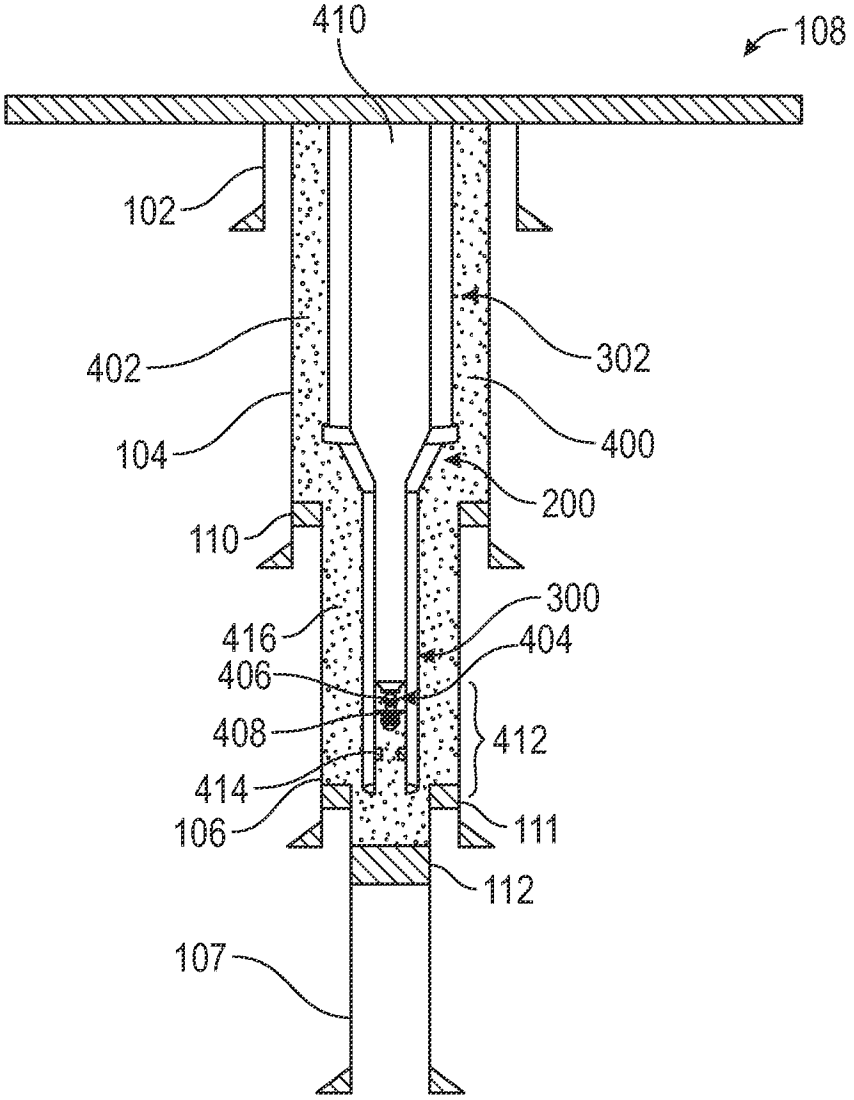
FIGS. 4*a* and 4*b* depict the system undergoing a cementing operation in accordance with one or more embodiments.
Figure 4A:
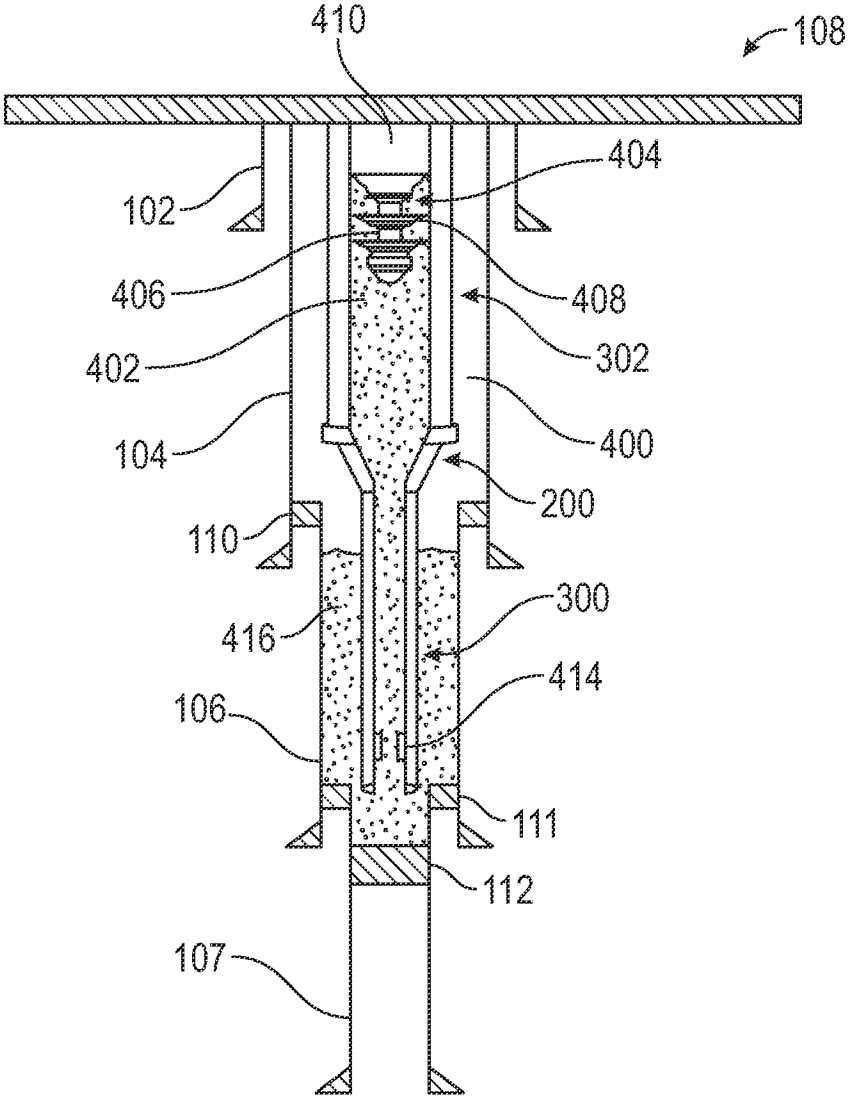

FIGS. 4*a* and 4*b* depict the system undergoing a cementing operation in accordance with one or more embodiments. Specifically, FIG. 4*a* shows a cross section of the system, depicted in FIG. 3, during the cementing operation. FIG. 4*b* shows the cross section of the system after the cementing operation has been completed. Components shown in FIGS. 4*a* and 4*b* that are the same as or similar to components shown in FIGS. 1-3 have not been redescribed for purposes of readability and have the same function as described above.

The cementing operation begins with a spacer fluid (400) being pumped into the workover well (100). The spacer fluid (400) is a fluid having properties that will not react to properties of the cement (402). The spacer fluid (400) is pumped from the surface location (108) into the tieback casing (302), the crossover (200), and the workover liner (300). The spacer fluid (400) is followed by the cement (402) pumped from the surface location (108) into the tieback casing (302), the crossover (200), and the workover liner (300). The cement (402) is a fluid designed to harden, or set, after a set period of time.

A wiper plug (404) follows the cement (402) and is pumped from the surface location (108) into the tieback casing (302), the crossover (200), and the workover liner (300). The wiper plug (404) is made of a drillable material, such as thermoplastic or rubber. The wiper plug (404) is made of a solid core (406) and collapsible fins (408). the collapsible fins (408) are disposed around the solid core (406). The fins (408), in their expanded state, fit flush within the inside of the tieback casing (302). The fins (408) collapse as the wiper plug (404) enters the crossover (200). The fins (408) collapse to a size such that the wiper plug (404) fits flush within the workover liner (300).

The wiper plug (404) is followed by a completion fluid (410). The completion fluid (410) may be any fluid that is designed to be left in the workover well (100) for a period of time such as water mixed with corrosion inhibitor. In other embodiments, the completion fluid (410) may be a fluid, like a drilling mud, that may be used to drill out the shoe track (412) and bridge plug (112) to put the workover well (100) back on production.

FIG. 4*a* shows the workover well (100) while the completion fluid (410) is being pumped from the surface location (108) and after the spacer fluid (400), cement (402), and wiper plug (404) have been pumped from the surface location (108). The wiper plug (404) creates a barrier between the cement (402) and completion fluid (410) such that little of the cement (402) and completion fluid (410) mixes.

The wiper plug (404) also wipes cement residual from the inside of the tieback casing (302), crossover (200), and workover liner (300). The cement (402) and the spacer fluid (400) have been pumped out of the workover liner bottom end (312) and into the annulus (416). The annulus (416) is the space located between an outer surface of the tieback casing (302)/crossover (200)/workover liner (300) and an inner surface of the production casing (104)/first production liner (106).

FIG. 4*b* shows the workover well (100) after the wiper plug (404) has been pumped to the float collar (414) of the workover liner (300). The float collar (414) may be located more or less than two joints of casing up hole from the workover liner bottom end (312). The float collar (414) may contain a check valve (not pictured) used to prevent a u-tube of cement (402) from the annulus (416) back into the workover liner (300). The float collar (414) may also have a profile designed to hold the wiper plug (404). The wiper plug (404) and the profile in the float collar (414) are sized such that the wiper plug (404) may not pass through the float collar (414).

The volumes of fluid (i.e., the spacer fluid (400), the cement (402), and the completion fluid (410)) pumped in the cementing operation are calculated such that by the time the wiper plug (404) reaches the float collar (414), the cement (402) has reached the surface location (108) or the cement (402) has reach the designated setting height in the annulus (416). FIG. 4*b* also shows the workover well (100) having a shoe track (412). The shoe track (412) includes the cement (402) left behind in the workover liner (300). The shoe track (412) also includes the wiper plug (404).

The shoe track (412) may be drilled out, along with the bridge plug (112), to put the workover well (100) in hydraulic communication with the producing formation such that formation fluids may be produced to the surface location (108) using the workover well (100). In other embodiments, the shoe track (412) is drilled out and the bridge plug (112) is retrieved using a retrieval tool to put the workover well (100) on production. When the workover well (100) is put on production, the cement (402) holds the workover liner (300), the crossover (200), and the tieback casing (302) in place within the workover well (100), and the cement (402) prevents leakage of the formation fluids out of the workover well (100). Further, the tieback casing (302) may be set inside a casing spool at the surface location (108) using mechanical slips which may support the weight of the tieback casing (302) and workover liner (300).

While the system depicted in FIGS. 4*a* and 4*b* show a singular wiper plug (404) system being utilized, a dual wiper plug (404) system or a dart system may be used without departing from the scope of this disclosure herein. Further, the cement (402) is shown as being pumped back to the surface location (108), however the cement (402) may be pumped to any required height in the annulus (416) without departing from the scope of this disclosure herein.

Figure 5:
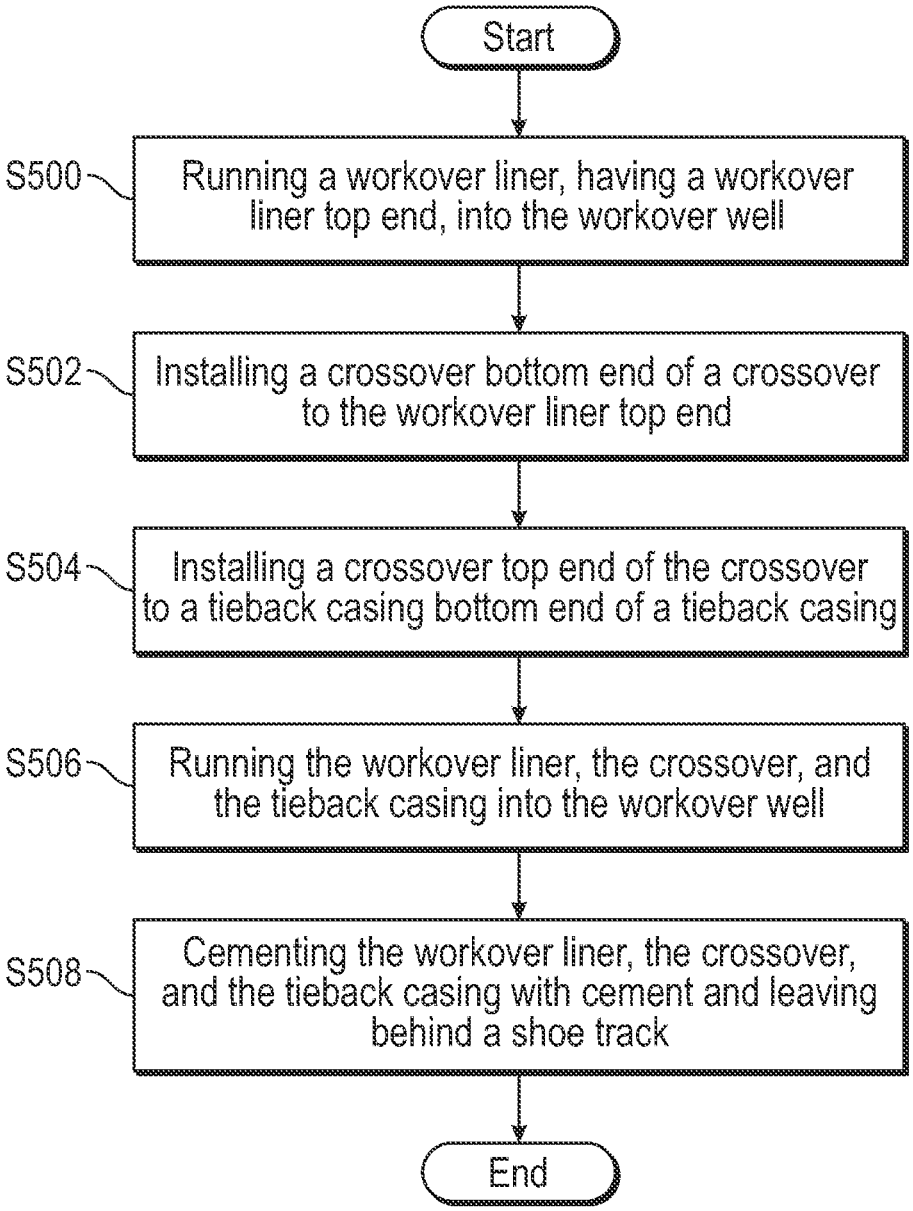
FIG. 5 depicts a flowchart in accordance with one or more embodiments.

FIG. 5 depicts a flowchart in accordance with one or more embodiments. The flowchart illustrates a method for a workover well (100) having a first production liner (106), a second production liner (107), two liner hangers (110, 111), and a production casing (104). Further, one or more blocks in FIG. 5 may be performed by one or more components as described in FIGS. 1-4*b*. While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a workover liner (300) having a workover liner top end (310) and a workover liner (300) bottom end is run into the workover well (100) (S500). Specifically, the workover liner (300) is run, initially, into the production casing (104). The workover liner bottom end (312) enters the workover well (100) first. The workover liner (300) is made from a plurality of joints of casing connected to one another. A crossover bottom end (204) of a crossover (200) is installed to the workover liner top end (310) (S502). The crossover bottom end (204) may be a pin end having external threads (211). The workover liner top end (310) may be a box end having internal threads. As such, the workover liner top end (310) may be threaded into the crossover bottom end (204).

A crossover top end (202) of the crossover (200) is installed to a tieback casing bottom end (306) of a tieback casing (302) (S504). The crossover top end (202) may be a box end having internal threads (210). The tieback casing bottom end (306) may be a pin end having external threads. As such, the tieback casing bottom end (306) is threaded into the crossover top end (202). The tieback casing (302) is made from a plurality of joints of casing connected to one another.

The workover liner (300), the crossover (200), and the tieback casing (302) are run into the workover well (100) (S506). The workover liner (300) is set within the first production liner (106), the crossover (200) is set above the liner hanger (110) of the first production liner (106), and the tieback casing (302) is set within the production casing (104) and extends to a surface location (108). The workover liner top end (310) may extend into the production casing (104) and the workover liner bottom end (312) may sting into the second production liner (107).

The workover liner (300), the crossover (200), and the tieback casing (302) are cemented with cement (402), and a shoe track (412) is left behind (S508). The cement (402) holds the workover liner (300), the crossover (200), and the tieback casing (302) in place within the workover well (100) and the cement (402) prevents leakage of fluids out of the workover well (100). The workover liner (300), the crossover (200), and the tieback casing (302) may be cemented using a wiper plug (404) cementing operation.

The wiper plug (404) cementing operation includes pumping a spacer fluid (400) from the surface location (108) into the tieback casing (302), the crossover (200), and the workover liner (300). The cement (402) is pumped behind the spacer fluid (400) from the surface location (108) into the tieback casing (302), the crossover (200), and the workover liner (300). A wiper plug (404) is pumped behind the cement (402) from the surface location (108) into the tieback casing (302), the crossover (200), and the workover liner (300). A completions fluid (410) is pumped behind the wiper plug (404) from the surface location (108) into the tieback casing (302), the crossover (200), and the workover liner (300).

The completion fluid (410) is pumped on the wiper plug (404) until the wiper plug (404) seats on the float collar (414) of the workover liner (300). As the wiper plug (404) is being pumped into the workover well (100) by the completion fluid (410), the wiper plug (404) is pushing the cement (402) out of the workover liner bottom end (312) into the annulus (416). By the time the wiper plug (404) seats on the float collar (414), the cement (402) has reached a pre-determined height in the annulus (416) which may be the surface location (108).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A method for a workover well, the workover well having a production liner, a liner hanger, and a production casing, the method comprising:

running a workover liner, having a workover liner top end, into the workover well, installing a crossover bottom end of a crossover to the workover liner top end;

installing a crossover top end of the crossover to a tieback casing bottom end of a tieback casing;

running the workover liner, the crossover, and the tieback casing into the workover well, wherein the workover liner is set within the production liner, the crossover is set above the liner hanger of the production liner, and the tieback casing is set within the production casing and extends to a surface location; and cementing the workover liner, the crossover, and the tieback casing with cement and leaving behind a shoe track, wherein the cement holds the workover liner, the crossover, and the tieback casing in place within the workover well and the cement prevents leakage of fluids out of the workover well.

2. The method of claim 1, wherein cementing the workover liner, the crossover, and the tieback casing further comprises pumping a spacer fluid from the surface location into the tieback casing, the crossover, and the workover liner.

3. The method of claim 2, wherein cementing the workover liner, the crossover, and the tieback casing further comprises pumping the cement from the surface location through the tieback casing, the crossover, and the workover liner.

4. The method of claim 3, wherein cementing the workover liner, the crossover, and the tieback casing further comprises pumping a wiper plug from the surface location through the tieback casing, the crossover, and the workover liner.

5. The method of claim 4, wherein the wiper plug comprises collapsible fins disposed around a solid core.

6. The method of claim 5, wherein cementing the workover liner, the crossover, and the tieback casing further comprises pumping a completions fluid on top of the wiper plug.

7. The method of claim 1, wherein the crossover bottom end is a pin end with external threads and the crossover top end is a box end with internal threads.

8. The method of claim 7, wherein the workover liner top end is a box end with internal threads and the tieback casing bottom end is a pin end with external threads.

9. The method of claim 8, wherein installing the crossover bottom end of the crossover to the workover liner top end further comprises threading the workover liner top end into the crossover bottom end.

10. The method of claim 9, wherein installing the crossover top end of the crossover to the tieback casing bottom end of the tieback casing further comprises threading the tieback casing bottom end into the crossover top end.

11. A system for a workover well, the workover well having a production liner, a liner hanger, and a production casing, the system comprising:

a tieback casing, having a tieback casing top end, a tieback casing bottom end, and a first outer diameter, located within the production casing of the workover well, and extending to a surface location;

a crossover, having a crossover top end and a crossover bottom end, wherein the crossover top end is connected to the tieback casing bottom end and the crossover is located in the workover well above the liner hanger of the production liner;

a workover liner, having a workover liner top end, a workover liner bottom end, and a second outer diameter, wherein the workover liner top end is connected to the crossover bottom end and the second outer diameter is smaller than the first outer diameter;

cement located in an annulus of the tieback casing, the crossover, and the workover liner; and a shoe track, made of cement, located within the workover liner bottom end.

12. The system of claim 11, further comprising:

a bridge plug set beneath a deepest setting point of the workover liner.

13. The system of claim 11, further comprising:

a wiper plug located above the shoe track.

14. The system of claim 13, wherein the wiper plug is made of a drillable material.

15. The system of claim 14, wherein the wiper plug comprises collapsible fins disposed around a solid core.

16. The system of claim 15, further comprising:

completions fluid located within the tieback casing, the crossover, and the workover liner and above the shoe track.

17. The system of claim 11, wherein the crossover bottom end is a pin end with external threads and the crossover top end is a box end with internal threads.

18. The system of claim 17, wherein the workover liner top end is a box end with internal threads and the tieback casing bottom end is a pin end with external threads.

19. The system of claim 18, wherein the internal threads of the crossover top end mate with the external threads of the tieback casing bottom end.

20. The system of claim 19, wherein the external threads of the crossover bottom end mate with the internal threads of the workover liner top end.

* * * * *